US011311895B2

(12) United States Patent
Baumann

(10) Patent No.: US 11,311,895 B2
(45) Date of Patent: Apr. 26, 2022

(54) FLUID DISPENSER HAVING A DISCHARGE HEAD

(71) Applicant: APTAR RADOLFZELL GMBH, Radolfzell (DE)

(72) Inventor: Tobias Baumann, Constance (DE)

(73) Assignee: APTAR RADOLFZELL, GMBH, Radolfzell (DE)

( * ) Notice: Subject to any disclaimer, the term of this patent is extended or adjusted under 35 U.S.C. 154(b) by 0 days.

(21) Appl. No.: 16/314,704

(22) PCT Filed: Jul. 10, 2017

(86) PCT No.: PCT/EP2017/067299
§ 371 (c)(1),
(2) Date: Jan. 2, 2019

(87) PCT Pub. No.: WO2018/019556
PCT Pub. Date: Feb. 1, 2018

(65) Prior Publication Data

US 2019/0314832 A1 Oct. 17, 2019

(30) Foreign Application Priority Data

Jul. 29, 2016 (EP) ..... 16182017

(51) Int. Cl.
*B05B 1/34* (2006.01)
*B05B 11/00* (2006.01)
(Continued)

(52) U.S. Cl.
CPC ..... *B05B 1/3452* (2013.01); *B05B 1/304* (2013.01); *B05B 1/3468* (2013.01); *B05B 11/3001* (2013.01); *B05B 11/304* (2013.01)

(58) Field of Classification Search
CPC ..... B05B 1/12; B05B 1/304; B05B 1/3436; B05B 1/3452; B05B 1/3467;
(Continued)

(56) References Cited

U.S. PATENT DOCUMENTS 3,061,203 A * 10/1962 Kitabayashi ..... B65D 83/34 239/337
3,648,932 A * 3/1972 Ewald ..... B05B 7/0425 239/337
(Continued)

FOREIGN PATENT DOCUMENTS

CN 1133572 A 10/1996
CN 101312893 A 11/2008
(Continued)

OTHER PUBLICATIONS

International Search Report issued in International Application No. PCT/EP2017/067299 with English translation dated Oct. 5, 2017 (5 pages).
(Continued)

*Primary Examiner* — Joseph A Greenlund
(74) *Attorney, Agent, or Firm* — Flynn Thiel, P.C.

(57) ABSTRACT

A fluid dispenser having an accumulator and a discharge head. The discharge head is secured to a base unit of the dispenser, which base unit includes a fluid accumulator. The discharge head has a housing displaceable relative to the base unit for actuating the dispenser. The discharge head has an inlet through which fluid travels from the fluid accumulator into the discharge head, and a discharge opening through which the fluid is delivered into the atmosphere. A swirling chamber having an inlet channel is provided between the fluid inlet and the discharge opening so that inflowing fluid is provided with a swirl which forms a spray stream when exiting the discharge opening. The swirling chamber is switched between a first and a second configu-
(Continued)

ration by changing the geometry of its walls and/or the inlet channel.

20 Claims, 3 Drawing Sheets

(51) Int. Cl.
*B05B 1/12* (2006.01)
*B05B 1/30* (2006.01)

(58) Field of Classification Search
CPC . B05B 11/3004; B05B 11/304; B05B 1/3468; B05B 11/0029; B05B 11/3054; B05B 11/3001; B65D 83/207
USPC ..... 239/492; 222/519–525, 544–563
See application file for complete search history.

(56) References Cited

U.S. PATENT DOCUMENTS 4,174,056 A 11/1979 Loeffler
4,189,064 A * 2/1980 O'Neill ..... B05B 11/3018 222/321.2
4,358,057 A * 11/1982 Burke ..... B05B 1/12 222/380
4,989,790 A 2/1991 Martin et al.
5,096,098 A 3/1992 Garcia
5,152,425 A * 10/1992 Baudin ..... B05B 3/02 222/1
5,388,766 A 2/1995 Buisson
5,516,045 A * 5/1996 Baudin ..... B05B 1/14 239/337
5,593,094 A * 1/1997 Barriac ..... B05B 1/3436 239/476
5,657,907 A * 8/1997 Dobbs ..... B05B 11/0032 222/153.14
5,704,550 A * 1/1998 Foster ..... B05B 1/3431 239/333
5,755,384 A * 5/1998 Foster ..... B05B 1/02 239/343
5,992,704 A * 11/1999 Jager-Waldau ..... B05B 11/0064 222/341
6,234,412 B1 * 5/2001 von Schuckmann ..... B05B 1/3473 239/333
6,257,461 B1 * 7/2001 Fuchs ..... B05B 1/00 222/383.1
6,443,370 B1 9/2002 Brulle et al.
6,533,196 B1 * 3/2003 Ouin ..... B05B 1/3436 239/476
6,776,309 B2 * 8/2004 Schultz ..... B05B 1/3436 222/321.1
7,172,098 B2 2/2007 Garcia et al.
8,333,332 B2 * 12/2012 Burghaus ..... B05B 15/528 239/114
8,844,841 B2 * 9/2014 Prater ..... B05B 11/0029 239/396
9,839,927 B2 * 12/2017 Spang ..... B05B 1/3026
2009/0256008 A1 * 10/2009 Foster ..... B05B 7/005 239/539
2009/0272765 A1 11/2009 Seki et al.
2010/0224652 A1 * 9/2010 Lim ..... A45D 34/04 222/256
2019/0160481 A1 * 5/2019 Baumann ..... B05B 1/3452
2019/0314832 A1 * 10/2019 Baumann ..... B05B 11/304

FOREIGN PATENT DOCUMENTS

CN 201768639 U 3/2011
DE 38 22 160 A1 1/1990
DE 195 25 729 A1 1/1997
EP 0 930 102 A1 7/1999
EP 1 047 505 A1 11/2000
EP 1 492 627 A1 1/2005
JP 0414154 U 2/1992
JP 2005169231 A 6/2005
JP 2007152276 A 6/2007
KR 20100099385 A 9/2010
WO WO 2014/138421 A1 9/2014

OTHER PUBLICATIONS

Written Opinion of International Searching Authority issued in International Application No. PCT/EP2017/067299 dated Oct. 5, 2017 (6 pages).
Chinese Office Action issued in corresponding Chinese Application No. 201780047229.2 with English translation of Search Report, dated Jun. 1, 2020 (11 pages).
Korean Office Action issued in corresponding Korean Application No. 10-2019-7003343 with English translation, dated Jul. 21, 2020 (19 pages).

* cited by examiner

FLUID DISPENSER HAVING A DISCHARGE HEAD

FIELD OF APPLICATION AND PRIOR ART

The invention relates to a fluid dispenser.

Generic fluid dispensers and their discharge heads serve for the purpose of delivering fluids in the form of a spray stream. This can relate in particular to cosmetic fluids, such as perfumes and the like, or to pharmaceutical fluids, such as remedies for insect stings for example, or foodstuffs, such as olive oil.

The generation of a spray stream requires high shear forces to be induced in the fluid, by means of which a fluid film or fluid flow is broken down into individual droplets. In the case of generic discharge heads, this takes place by means of a swirling chamber into which the fluid flows eccentrically through one or more inlet channels so that a rotating fluid flow is established in the swirling chamber, which is broken down as it exits through a discharge opening owing to the swirl and the kinetic energy.

With regard to many fluids, however, there is a wish to also discharge these in a non-atomized form, i.e. in the form of a jet/flow or in drop form.

Most of the discharge heads and fluid dispensers known from the prior art are designed for discharging fluid either in an atomized form or in the form of a jet/flow or in drop form.

OBJECT AND SOLUTION

The object of the invention is to provide a fluid dispenser having a discharge head, which optionally enables discharging in an atomized form or in the form of drops or a jet/flow.

This object is achieved by a fluid dispenser which comprises a fluid accumulator for receiving fluid before the discharge procedure and a discharge head mounted thereon.

The fluid dispenser can possess a pump device, which can be actuated by a relative translative movement of the discharge head with respect to the base unit and conveys fluid from the fluid accumulator into the discharge head. Such a fluid dispenser possesses a fluid accumulator, in which the fluid is unpressurized. By pressing down the pump device, a pump chamber, which is preferably provided with pressure relief valves on the input side and output side, is volumetrically reduced so that the fluid is conveyed into the discharge head and in the direction of a swirling chamber and a discharge opening.

Alternatively, the fluid accumulator can be formed as a pressure accumulator and the fluid accumulator can possess a valve device, which can be actuated by a relative translative movement of the discharge head with respect to the base unit and conveys fluid from the fluid accumulator into the discharge head. In the case of such a design, pressing down the discharge head with respect to the fluid accumulator merely results in opening an outlet valve. The pressurization of the fluid is already in effect owing to the design of the fluid accumulator as a pressure accumulator so that, when the outlet valve is open, the fluid flows in the direction of the swirling chamber and the discharge opening.

The discharge head, which is provided for securing to the base unit of the fluid dispenser, has a housing which is preferably displaceable with respect to the base unit for the purpose of actuating the fluid dispenser. It has a fluid inlet, through which fluid to be discharged can make its way from the fluid accumulator into the discharge head, and has a discharge opening, through which the fluid can be delivered into a surrounding atmosphere.

A swirling chamber having at least one eccentrically leading inlet channel is provided between the fluid inlet and the discharge opening so that inflowing fluid can be provided with a swirl which brings about the formation of a spray stream as it exits the discharge opening.

The swirling chamber can be switched at least between a first and a second configuration by changing the geometry of walls of the swirling chamber and/or the at least one inlet channel. A handle is provided for manually switching between the configurations. In a first configuration, the fluid is delivered as a spray stream. In a second configuration, the fluid is delivered as a flow/jet. Designs are also possible in which there are further intermediate configurations.

The discharge head of a fluid dispenser according to the invention, which is used for transferring the fluid to be discharged from the inlet channel to the discharge opening, has, according to the invention, a swirling chamber which can be activated and deactivated manually, as it were, by the user of the fluid dispenser. If the swirling chamber is activated, owing to the geometry and relative arrangement of its walls, the swirling chamber itself, or an inlet channel penetrating the swirling chamber eccentrically and preferably tangentially, has a geometry which is suitable for inducing a swirl by means of which a spray cone is generated as the fluid exits through the discharge opening. By means of the handle, the user can switch to the second configuration in which fluid in the form of a continuous fluid flow/fluid jet or in drop form is delivered instead of a spray stream. In this second configuration, the walls of the swirling chamber and/or the shape of the inlet channel are changed in such a way that a swirl is no longer generated in the fluid or this swirl turns out to be so slight that it is insufficient for forming a spray stream.

Therefore, the user of the fluid dispenser can establish case by case whether he would like a product to be sprayed or whether he would like it to be released in the form of a fluid flow or drops. This is a useful option for example in areas of application such as the discharging of perfume or olive oil.

The change in the geometry of the swirling chamber and/or the inlet channel is preferably brought about in that the swirling chamber or the inlet channel is delimited by two swirling chamber components which are movable relative to one another. As a result of the manual actuation of the handle by the user, the relative position of these swirling chamber components is altered and, with this, the efficacy of the swirling chamber. Options for influencing the efficacy of the swirling chamber consist in particular in reducing the flow resistance into the swirling chamber through the relative movement of the swirling chamber components to prevent turbulence from forming and/or altering the eccentricity of the fluid inflow since the swirl can also be influenced in this way.

The swirling chamber components are preferably movable relative to one another in a translative manner, i.e. slidingly movable along a guide. For structural simplicity, it is in particular preferred if the swirling chamber components are linearly movable relative to one another.

A first swirling chamber component, in which a through-hole forming the discharge opening is preferably provided, is preferably provided, on an inner side, with a depression whereof the walls delimit the swirling chamber, and/or it is provided with a groove whereof the walls delimit the inlet channel into the swirling chamber. The second swirling chamber component has an end contact face which, in the first configuration, abuts against the first swirling chamber component so the contact face, together with the depression, delimits the swirling chamber and/or the contact face, together with the walls of the groove, forms the inlet channel.

The said configuration represents a very simple construction of the swirling chamber components. In this case, both swirling chamber components have mutually facing contact faces, which preferably result in a planar contact of the swirling chamber components with one another. At least one of these contact faces has depressions which form the swirling chamber itself and/or the at least one inlet channel flowing eccentrically into the swirling chamber. However, a design is also conceivable in which the depression forming the swirling chamber is provided on one of the swirling chamber components and the depression forming the inlet channel is provided on the other swirling chamber component. If the contact faces abut against one another, the inlet channel and the swirling chamber are circumferentially closed and therefore have a geometry which is suitable for forming the swirl within the fluid in the swirling chamber. If the two contact faces are remote from one another, a gap is therefore produced between them, through which fluid can flow directly and centrically into the swirling chamber, mostly bypassing the inlet channel, whereby the flow resistance which is associated therewith is normally reduced in the process. In this second configuration, the fluid preferably flows into the swirling chamber through the circumferentially produced annular gap.

It is essentially possible for either the swirling chamber component which comprises the discharge opening or the swirling chamber component which does not comprise the discharge opening to be that which is displaced with respect to the housing of the discharge head. However, a design is preferred in which the swirling chamber component provided with the discharge opening is formed to be stationary with respect to the housing or formed by the housing itself, whilst the displaceable swirling chamber component is an internal component of the discharge head, the position of which is preferably not visible from the outside in this case.

The discharge head, as a whole, can represent the handle for manually switching between the configurations. This is realized for example in a design in which the discharge head is mounted on a base such that it is relatively movable thereto and the mutual relative position of the swirling chamber components can be brought about by a relative displacement of the discharge head and the base.

In an alternative design, it is provided that a button for manually switching between the configurations is provided on the discharge head itself, which button is displaceable with respect to the housing of the discharge head and directly or indirectly influences the relative position of the swirling chamber components. A direct influence is realized if the button is formed to be stationary with respect to a swirling chamber component so that the displacement of the button likewise also brings about a displacement of one of the swirling chamber components with respect to the housing.

Alternatively, it can be provided that, between the button and the swirling chamber component, a transmission or gear is provided via which the movement of the button with respect to the housing is coupled to the movement of the swirling chamber component with respect to the housing. Such a transmission or gear can be formed for example by two inclined planes on sides of the button and on sides of the swirling chamber component, which planes slide against one another.

A restoring spring is preferably provided, which acts between the swirling chamber components so that the swirling chamber components constantly have a force applied to them in the direction of an end position and are displaced in opposition to the force of the restoring spring as a result of a force being applied to the button.

The restoring spring brings about that only one of the configurations, i.e. only one of the mutual relative positions of the swirling chamber components, is stable. The swirling chamber components therefore remain in the other, unstable configuration only whilst the user applies a force to the button. Such a design is in particular expedient if the button for switching between the configurations is mounted in the region of an actuating face of the discharge head to which a force can be intentionally applied in order to initiate a discharging of fluid. In the case of such a design, by applying a force to the said actuating face or the button adjacent thereto, the user can, at the same time, select the configuration for the discharge procedure and induce the discharge procedure.

Alternatively to a button which is provided on the discharge head and is displaceable with respect to the discharge head, in order to change the configuration of the discharge head it can, in a manner already described, also be provided that the discharge head is formed to be rotatable about an axis of rotation with respect to the base unit and a transmission or gear is provided, by means of which a rotational movement of the discharge head brings about a relative displacement of the swirling chamber components. The advantage of such a design is, in particular, that the movement for initiating a discharge procedure, usually the pressing-down of the discharge head, is separate from the movement for switching between the configurations by changing the relative displacement of the swirling chamber components. The user can therefore firstly change the configuration of the discharge head in a potentially very convenient and very precise manner and then trigger a discharge procedure according to the selected configuration by pressing down the discharge head.

The transmission or gear preferably comprises a guide element which is at an angle-dependent spacing from the axis of rotation or is provided on the base unit, and a guide slide which is in engagement with the guide element and which is provided on the base unit or on one of the swirling chamber components.

The angle-dependent spacing is preferably generated by a spiral sectional shape. If the guide slide slides along the guide element, it thus also changes its spacing from the axis of rotation and therefore induces a radial displacement. Alternatively, in the case of a radially fixed guide slide, the guide element could also undergo a radial displacement. This radial displacement can be used to displace one of the swirling chamber components radially.

BRIEF DESCRIPTION OF THE DRAWING

Further advantages and aspects of the invention are revealed in the claims and in the description below of preferred exemplary embodiments of the invention, which are explained below with reference to the figures.

DETAILED DESCRIPTION OF THE EXEMPLARY EMBODIMENTS

Figure 1:
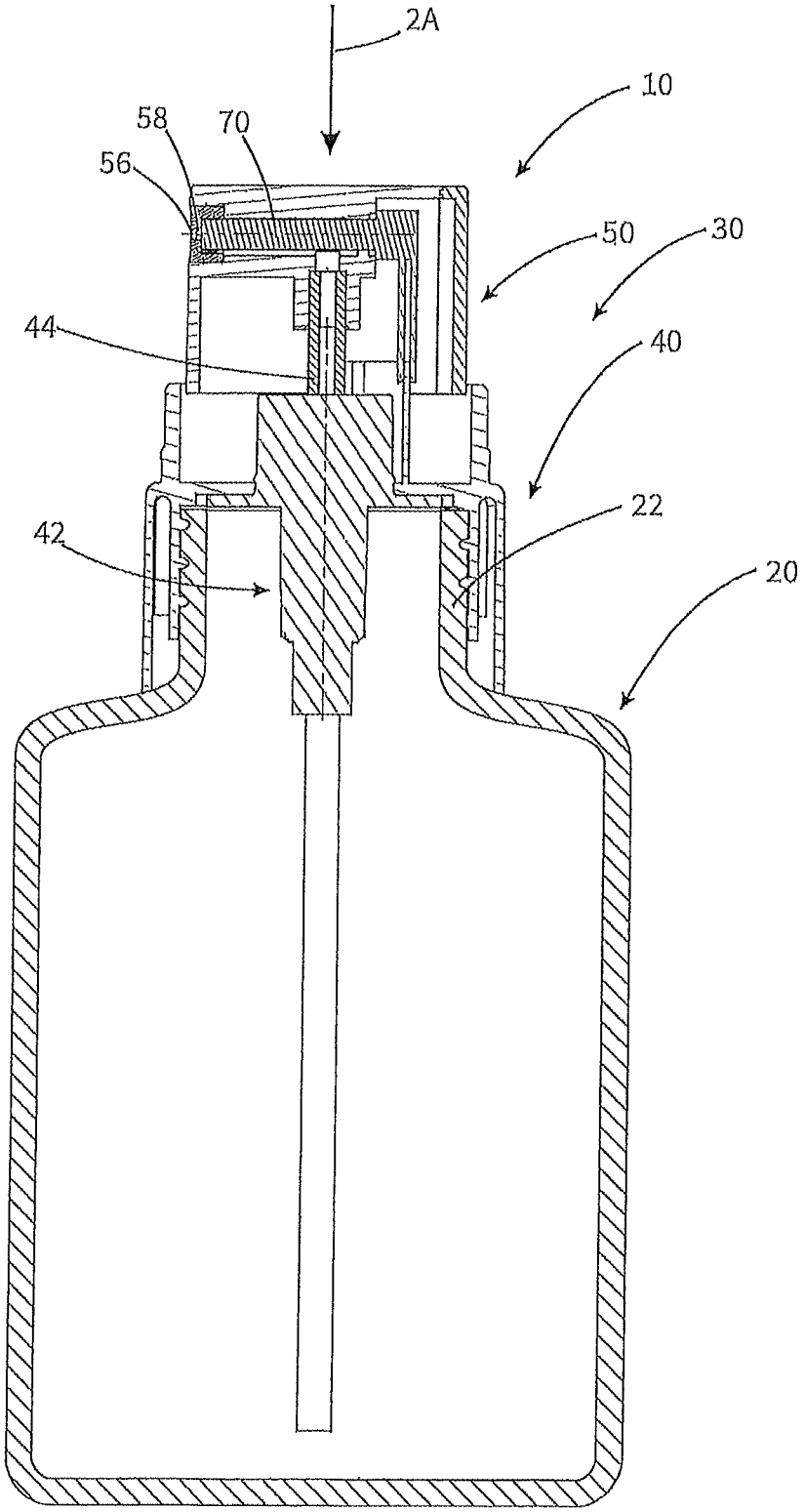
FIG. 1 shows a fluid dispenser according to the invention in an overall view.

FIG. 1 shows a fluid dispenser 10 according to the invention in an overall view. This fluid dispenser 10 possesses a fluid accumulator 20 and a discharge device 30, which is screwed to a neck 22 of the fluid accumulator 20.

The discharge device 30 in turn possesses a base 40, which is stationary with respect to the fluid accumulator, and a discharge head 50 which is provided on the base 40 and can be pressed down in an actuating direction 2A. An outlet control 42 in the form of a valve device or a pump device, which has an outlet connection 44 at its upper end, is furthermore provided on the base 40. Depending on the design, if this outlet connection 44 is pressed down in direction 2A, the outlet control 42 formed as a valve device is opened so that pressurized fluid can flow into the discharge head 50, or a pump procedure is brought about at the outlet control 42 formed as a pump device, so that fluid is conveyed from a pump chamber (not illustrated) into the discharge head and, upon a subsequent return stroke, the pump chamber is refilled from the fluid accumulator 20.

The discharge head 50 is also explained in more detail with reference to FIGS. 2 and 3. The discharge head 50 has a multi-part housing 52, which possesses a discharge opening 56 in a separate nozzle component 54. Connected upstream of the discharge opening 56 is a swirling chamber 58 into which tangentially aligned inlet channels 60 lead.

Figure 4A:
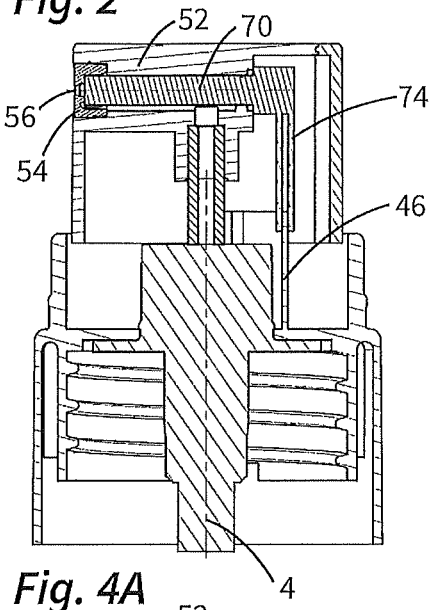
FIGS. 4A and 4B and 5A and 5B each show, sectioned along two different planes, the discharge device of the dispenser of FIG. 1 in two varying configurations.

As a result, in the configuration of FIG. 4A, owing to an end face 72 of a plunger component 70 abutting against the nozzle component 54, fluid flowing into the discharge head at the fluid inlet 62 flows into the swirling chamber 58 through the tangential inlet channels 60 and is thereby provided with a swirl. This swirl brings about the production of a spray cone comprising tiny droplets of the fluid during the discharge procedure. This is the first possible configuration of the discharge head 50.

Figure 2:
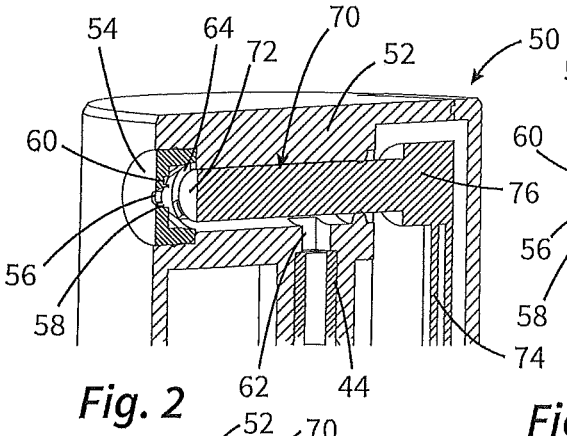
FIGS. 2 and 3 show the discharge head of the dispenser of FIG. 1 in two sectional, perspective views.
Figure 3:
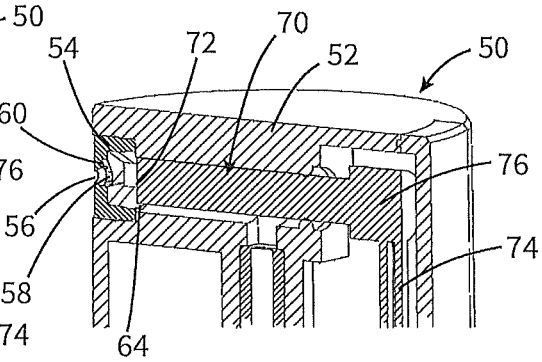
Figure 5A:
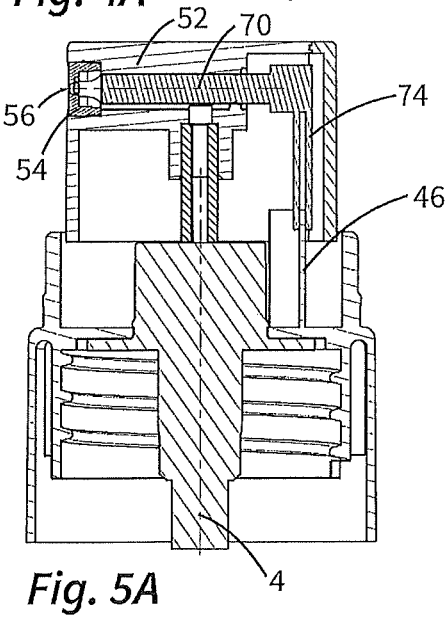

A second possible configuration is illustrated in FIG. 5A and furthermore also in the said FIGS. 2 and 3. In relation to the first configuration, the plunger component 70 in this second configuration is displaced in the radial direction to the right of the component 54 principally forming the swirling chamber. This brings about that the swirling chamber 58 itself and the inlet channel 60 flowing tangentially into it are each opened, as it were. In this case, the inlet channel 60 loses its function almost completely, since fluid can now flow into the swirling chamber via an annular gap 64. Therefore, a fluid swirl is also no longer formed to a relevant extent in the swirling chamber 58. Instead, the fluid is discharged through the discharge opening 56 as a non-atomized stream (jet).

Figure 4B:
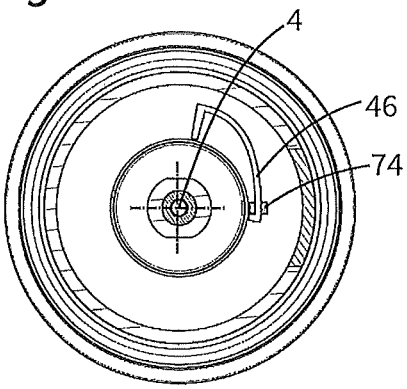
Figure 5B:
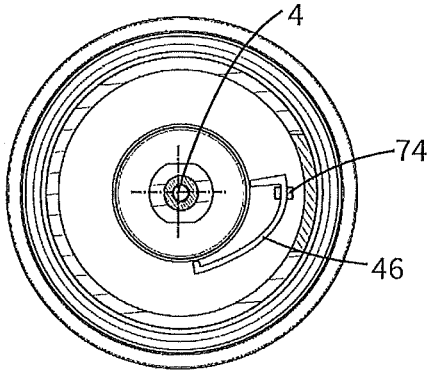

FIGS. 4A and 4B on the one hand and FIGS. 5A and 5B on the other again illustrate the change in the relative position of the plunger component 70 with respect to the swirling chamber component 54. This refers in particular to the variation between the configurations. In FIG. 4A it can be seen that a flat web extending in the discharge head 50 is provided on the base 40, which web forms a guide element 46. As can be seen with reference to FIG. 4B, this guide element 46 does not surround the center axis 4 at a constant spacing but is instead designed in the form of a spiral section. This guide element 46 cooperates with a guide slide 74, which is provided at the rear end 76 of the plunger component 70. This cooperation between the guide element 46 and the guide slide 74 brings about that a rotation of the discharge head 50 with respect to the base 40 also brings about a radial displacement of the guide slide 74 in the manner illustrated by FIGS. 4B and 5B. This radial displacement simultaneously brings about the desired radial displacement of the plunger component 70 and its end face 72, so that the said configurations can be varied as a result of the rotational movement.

Figure 6A:
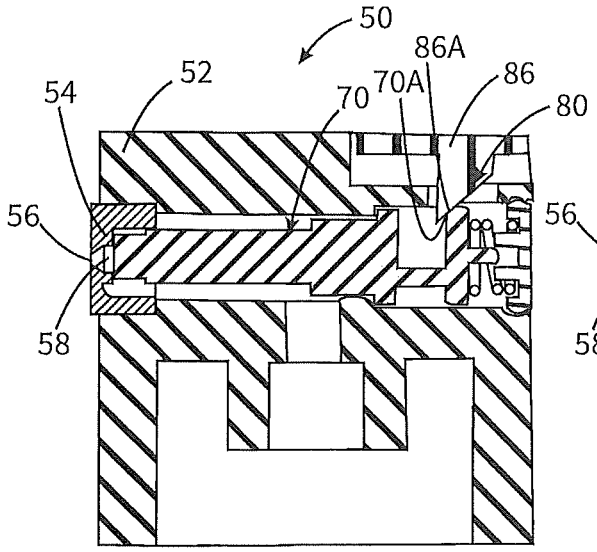
FIGS. 6A and 6B show a second variant of a discharge head for a fluid dispenser according to the invention.
Figure 6B:
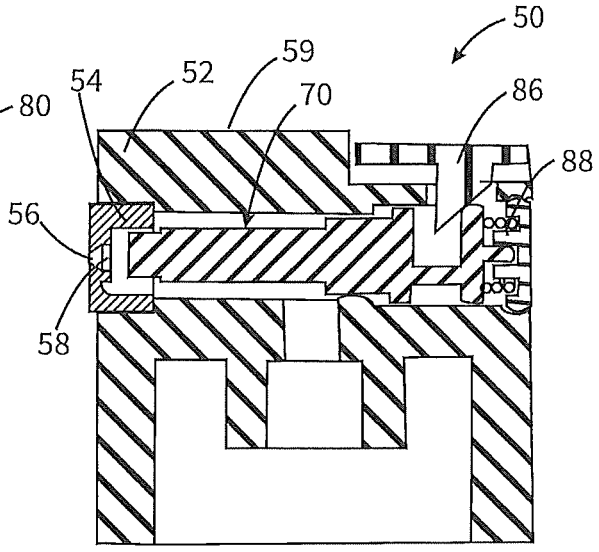

FIGS. 6A and 6B show a second variant, the mode of operation of which corresponds to the design described above in terms of activating and deactivating the generation of the spray stream by opening and closing the swirling chamber 58. However, deviating from the design described above, it is provided in this case that the plunger component 70 is pressed permanently in the direction of the configuration of 6A, i.e. the spray configuration, via a spring 88. To deflect the plunger component 70, a button 86 is provided which enables a deflection of the plunger component 70 in opposition to the force of the spring 88 via a transmission or gear 80 in the form of two planar portions 70A, 86A sliding against one another.

It is therefore possible to generate a non-atomized discharge stream by applying a pressing-down force to the discharge head in the region of the button 86. However, if the discharge head 50 has a force applied to it on the upper side 59 of the housing 52, adjacent to the button 86, a spray stream is generated.

Figure 7A:
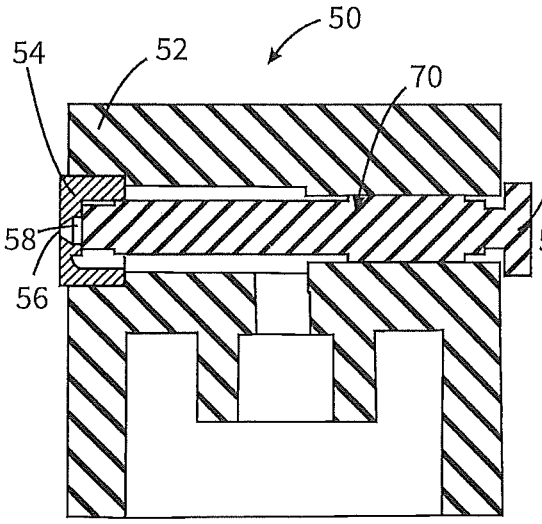
FIGS. 7A and 7B show a third variant of a discharge head for a fluid dispenser according to the invention.
Figure 7B:
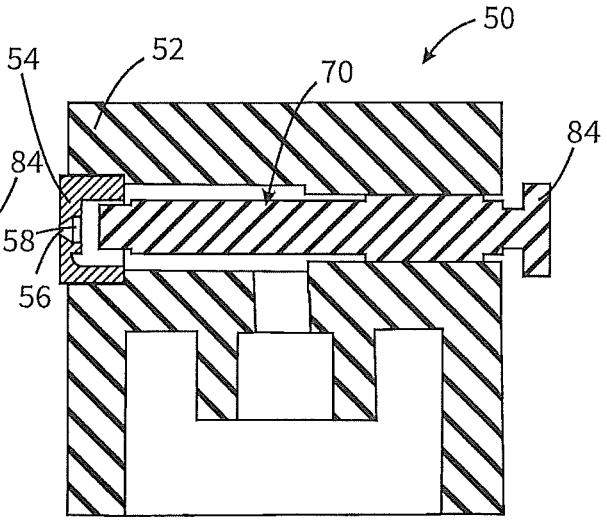

In the design of FIGS. 7A and 7B, the construction is again simplified. In this case, a handle 84 is provided on the plunger component 70 at its rear end, which handle permits the two configurations for generating a spray stream or a non-atomized fluid stream by means of a pulling-out or pressing-in maneuver.

The invention claimed is:

1. A fluid dispenser comprising:

a base unit including a fluid accumulator for receiving fluid prior to a fluid discharge procedure;

a discharge head secured to said base unit at a first side of said discharge head, said discharge head having a housing displaceable linearly relative to said base unit along a linear movement direction for actuating said fluid dispenser, a fluid inlet disposed to receive fluid from said fluid accumulator and a discharge opening through which fluid is discharged from said fluid dispenser;

a pump device actuable by movement of said housing of said discharge head relative to said base unit and conveying fluid from said fluid accumulator into said discharge head, or said fluid accumulator comprises a pressure accumulator and said fluid dispenser comprises a valve device actuable by movement of said housing of said discharge head relative to said base unit and conveying fluid from said fluid accumulator into said discharge head; and a swirling chamber including at least one eccentrically oriented inlet channel disposed between said fluid inlet and said discharge opening such that fluid flowing into said discharge head is provided with a swirl which forms a spray stream upon exiting said discharge opening, said swirling chamber being switchable between a first configuration and a second configuration during operation of said fluid dispenser by changing geometry of said swirling chamber and/or said inlet channel, said discharge head further including a swirling chamber component movably mounted in said discharge head and a button operatively connected to said swirling chamber component for manually switching said swirling chamber between said first configuration and said second configuration by displacing said swirling chamber component, said button being disposed on a second side of said discharge head disposed opposite and remote from said first side thereof, said button being linearly movable relative to said housing of said discharge head along a linear movement direction substantially parallel to the linear movement direction of said housing of said discharge head relative to said base unit.

2. The fluid dispenser according to claim 1, wherein said swirling chamber component is a first swirling chamber component and said fluid dispenser further comprises a second swirling chamber component, and said swirling chamber is switchable between said first configuration and said second configuration by displacement of said first swirling chamber component relative to said second swirling chamber component which changes the geometry of said swirling chamber and/or said inlet channel, said first and second swirling chamber components at least partially defining said swirling chamber and/or said inlet channel.

3. The fluid dispenser according to claim 2, wherein said second swirling chamber component includes a wall on an inner side thereof, said wall defining a depression which at least partially defines said swirling chamber and/or at least partially defines a groove at least partially forming said inlet channel leading into said swirling chamber, said first swirling chamber component including a contact face, said contact face in said first configuration of said swirling chamber abutting against said second swirling chamber component such that said contact face and said depression together define said swirling chamber and/or such that said contact face and said groove together define said inlet channel.

4. The fluid dispenser according to claim 3, wherein said second swirling chamber component defines said discharge opening of said discharge head.

5. The fluid dispenser according to claim 4, wherein in said second configuration of said swirling chamber, said first swirling chamber component and said second swirling chamber component are spaced from one another by an annular gap through which fluid flows in a direction of said discharge opening.

6. The fluid dispenser according to claim 5, wherein said second swirling chamber component is non-movably fixed to, and forms part of, said housing of said discharge head, and said first swirling chamber component is displaceable relative to said housing.

7. The fluid dispenser according to claim 2, wherein actuation of said button causes displacement of said first swirling chamber component relative to said second swirling chamber component, and said button is coupled to said first swirling chamber component by a transmission.

8. The fluid dispenser according to claim 7, further including a restoring spring disposed to act between said first swirling chamber component and said second swirling chamber component so as to apply a force on said first swirling chamber component in a direction of an end position thereof corresponding to said first configuration of said swirling chamber, whereby an actuation force applied to said button displaces said first swirling chamber component relative to said second swirling chamber component in opposition to the force of said restoring spring.

9. The fluid dispenser according to claim 2, wherein said first and second swirling chamber components have contact faces which abut one another in said first configuration of said swirling chamber to place said swirling chamber in a closed configuration in which fluid flowing into said discharge head is provided with a swirl which forms the spray stream upon exiting said discharge opening, and said contact faces in said second configuration of said swirling chamber are spaced from one another and form a gap therebetween to place said swirling chamber in an open configuration in which fluid flowing into said discharge head flows through said gap and exits said discharge opening substantially without being provided with a swirl upon exiting said discharge head.

10. The fluid dispenser according to claim 9, wherein said second swirling chamber component is fixed to said housing of said discharge head and defines said discharge opening, said button being operatively connected to said first swirling chamber component such that actuation of said button causes displacement of said contact face of said first swirling chamber component in a direction away from said contact face of said second swirling chamber component.

11. The fluid dispenser according to claim 10, wherein said first swirling chamber component is biased in said first configuration of said swirling chamber by a biasing member disposed on said discharge head, said housing of said discharge head having an actuating face disposed sidewardly adjacent said button, wherein a pressing force applied only to said actuation face of said housing and not to said button displaces said housing relative to said base unit along the linear movement direction of said housing and actuates said fluid dispenser with said swirling chamber in said closed configuration, and a pressing force applied to said button displaces said housing relative to said base unit along the linear movement direction of said housing and actuates said fluid dispenser with said swirling chamber in said open configuration.

12. The fluid dispenser according to claim 1, wherein said discharge head further includes an actuating face disposed at an uppermost portion of said discharge head and configured for receiving a pressing force which displaces said housing relative to said base unit along the linear movement direction of said housing and actuates said fluid dispenser, said button being disposed at said uppermost portion sidewardly adjacent said actuating face.

13. The fluid dispenser according to claim 1, wherein said discharge opening is disposed in said housing, and said housing of said discharge head is disposed in a telescoping manner with said base unit for linear movement along the linear movement direction of said housing for actuating said fluid dispenser.

14. The fluid dispenser according to claim 1, wherein said button is configured and disposed such that a pressing force applied to said button displaces said button and displaces said housing relative to said base unit along the linear movement direction of said housing and actuates said fluid dispenser.

15. The fluid dispenser according to claim 1, wherein said housing of said discharge head has an actuating face disposed sidewardly adjacent said button and configured for receiving a pressing force to actuate said housing and displace said housing relative to said base unit along the linear movement direction of said housing, and said actuating face of said housing is configured for actuation independently from actuation of said button.

16. The fluid dispenser according to claim 1, wherein said button is mounted on said housing of said discharge head.

17. The fluid dispenser according to claim 1, wherein said swirling chamber component is a first swirling chamber component and said fluid dispenser further comprises a second swirling chamber component and a biasing member disposed to act between said first swirling chamber component and said second swirling chamber component so as to apply a force on said first swirling chamber component in a direction of an end position thereof corresponding to said first configuration of said swirling chamber, whereby an actuation force applied to said button displaces said first swirling chamber component relative to said second swirling chamber component in opposition to the force of said biasing member.

18. The fluid dispenser according to claim 1, wherein manual actuation of said button during a discharge operation of said fluid dispenser switches said swirling chamber between said first configuration in which fluid exiting said discharge opening has a first form of discharge and said second configuration in which fluid exiting said discharge opening has a second form of discharge different from said first form of discharge.

19. The fluid dispenser according to claim 1, wherein said swirling chamber component is a first swirling chamber component and said fluid dispenser further comprises a second swirling chamber component fixed to said housing and defining said discharge opening, and actuation of said button switches said swirling chamber between said first configuration and said second configuration by displacement of said first swirling chamber component relative to said second swirling chamber component.

20. The fluid dispenser according to claim 1, wherein actuation of said button displaces said swirling chamber component relative to said discharge opening.

* * * * *